United States Patent [19]

Kopko

[11] Patent Number: 4,544,618

[45] **Date of Patent: * Oct. 1, 1985**

[54] DEVELOPMENT PROCESS UTILIZING CONDUCTIVE MATERIALS

[75] Inventor: John J. Kopko, Macedon, N.Y.

[73] Assignee: Xerox Corporation, Stamford, Conn.

[ * ] Notice: The portion of the term of this patent subsequent to Jan. 18, 2000 has been disclaimed.

[21] Appl. No.: 340,570

[22] Filed: Jan. 18, 1982

[51] Int. Cl.[4] ..... G03G 13/08; G03G 13/09

[52] U.S. Cl. ..... 430/102; 430/120; 430/122; 355/3 DD; 118/653; 118/656; 118/657; 118/658

[58] Field of Search ..... 430/102, 120, 122, 123; 355/3 DD; 118/653, 656, 657, 658

[56] References Cited

U.S. PATENT DOCUMENTS

| | | | |
|---|---|---|---|
| 3,900,001 | 8/1975 | Fraser et al. | 118/658 |
| 3,970,571 | 7/1976 | Olson et al. | 430/110 X |
| 4,013,041 | 3/1977 | Armstrong et al. | 118/656 |
| 4,076,857 | 2/1978 | Kasper et al. | 430/120 |
| 4,081,571 | 3/1978 | Nishihama et al. | 430/120 |
| 4,121,931 | 10/1978 | Nelson | 430/120 |
| 4,154,520 | 5/1979 | Nishikawa et al. | 355/3 DD |
| 4,251,612 | 2/1981 | Chu et al. | 430/58 X |
| 4,368,970 | 1/1983 | Hays | 430/122 X |

*Primary Examiner*—Roland E. Martin
*Attorney, Agent, or Firm*—E. O. Palazzo

[57] ABSTRACT

This invention is directed to an improved process for causing the development of electrostatic latent images on an imaging member comprising providing a development zone situated between a tensioned deflected flexible imaging member and a transporting member, adding conductive developer particles to the development zone comprised of toner particles and conductive magnetic carrier particles, causing the flexible imaging member to move at a speed of from about 5 cm/sec to about 80 cm/sec, causing the transporting member to move at a speed of from about 6 cm/sec to about 160 cm/sec, said flexible member and said transporting member moving at different speeds, maintaining a distance between the tensioned deflected flexible imaging member and the transporting member of from about 0.05 millimeters to about 1.5 millimeters, introducing a high electric field in the development zone, wherein the developer particles contained in the development zone are agitated, thereby providing contact between the conductive carrier particles, causing charge to rapidly flow in the direction of the deflected imaging member, said process being accomplished in the presence of a low magnetic field of less than 150 gauss, and a method of imaging utilizing such a process.

13 Claims, 2 Drawing Figures

DEVELOPMENT PROCESS UTILIZING CONDUCTIVE MATERIALS

BACKGROUND OF THE INVENTION

This invention generally relates to a process for accomplishing the development of images in electrostatographic imaging systems, and more specifically, the present invention is directed to an improved process for accomplishing the development of electrostatic latent images, by providing a development zone situated between a deflected flexible imaging member and a transporting member, wherein the imaging member is deflected by conductive developer particles, comprised of toner particles and conductive contacting carrier particles contained in the development zone, which deflection is primary responsible, together with the movement of said members, for the agitation and movement of developer particles. A process utilizing conductive developer materials allows the continual development of high quality images, including the efficient and effective development of solid areas.

The development of images by electrostatographic means is well-known, and in these systems, toner particles are applied to an electrostatic latent image to be developed by using, for example, various development methods including cascade development as described in U.S. Pat. No. 3,618,552, magnetic brush development as described in U.S. Pat. No. 2,874,063, and powder cloud development as described in U.S. Pat. No. 2,217,776. Powder cloud development and cascade development methods have been found to be especially well-suited for the development of line images common to business documents, however, images containing solid areas are not generally faithfully reproduced by these methods. The development of magnetic brush systems, however, provided an improved method for producing both line images and solid areas.

In magnetic brush development systems it is generally desirable to attempt to regulate the thickness of the developer composition which is transported on a roller, by causing the roller to move past a metering blade. Metering blade adjustment is important since the development zone the flow of developer material is determined by a narrow restrictive opening situated between the transporting roller and the imaging surface. Accordingly, in order to provide sufficient toner particles for the imaging surface, it is generally necessary to compress the developer bristles, thereby allowing toner particles adhering to the carrier particles near the ends of the bristle to be available for development. Any variation or non-uniformity in the amount of developer material metered onto the transport roller, or into the space in between the roller and imaging member, can result in undesired developer flow and non-uniform image development. The non-uniform image development can be minimized by carefully controlling the run-out on the developer roller and on the imaging member; and by providing a means for side to side adjustment in the relative positions of the metering blade, the development roller, and imaging member. When the imaging member is a flexible photoconductive belt, an improvement in the uniformity of development can be obtained by maintaining that portion of the belt in a slackened or non-tensioned condition so that the belt is capable of moving freely toward and away from the developer roller in response to the varying contours thereof as disclosed, for example, in U.S. Pat. No. 4,013,041.

The developer materials presently utilized in magnetic brush development systems differ widely in their electrical conductivity, thus, at one extreme in conductivity such materials can be insulating, in that a low electrical current is measured when a voltage is applied across the developer. Solid area development with insulating developer compositions is accomplished by metering a thin layer of developer onto a development roll, which is in close proximity to the image bearing member, the development roll functioning as an electrode and thus increasing the electrostatic force acting on the developer particles.

Insulating developer compositions can be rendered conductive by utilizing a magnetic carrier material which supports a high electric current flow in response to an applied potential. Generally, the conductivity of developer compositions depends upon a number of factors, including the conductivity properties of the magnetic carrier, the concentration of the toner particles, the magnetic field strength, the spacing between the imaging member and the development roll, and developer degradation due to toner smearing on the carrier particles. Also, when insulative toner particles are permanently bonded to a conductive carrier, the conductivity decreases to a critical value below which solid area development becomes inadequate, however, within certain limits the process and material parameters can be adjusted somewhat to recover the decrease in solid area developability. As indicated hereinafter, conductive magnetic carrier particles which render the developing composition conductive are employed in the process of the present invention.

It is known that when employing conductive developer materials in electrostatographic imaging systems that the development electrode members are maintained at a close effective distance from the image bearing member, wherein a high electrostatic force acts only on those toner particles which are adjacent to said members. Thus, since the electrostatic force for development in such systems are not strongly dependent upon the developer layer thickness, the uniformity of solid area development is improved despite a variation in the spacing between the image bearing member and the development roller member. While solid area deposition is not limited by a layer of net charged developer material near the imaging surface in magnetic brush systems utilizing conductive developer material, primarily since the charge is dissipated by conduction to a development roller, solid area deposition is limited by image field neutralization, provided there is sufficient toner available at the ends of the developer brush, which toner supply is limited to the ends of tips of the bristles, since toner cannot be extracted from the bulk of the developer, where high developer conductivity collapses the electric field within the developer at any location and confines it to a region located between the latent image and the developer composition. For either insulative or conductive developers, solid area deposition is limited by toner supply at low concentrations, and the toner supply is further limited to a layer of carrier material adjacent to the image bearing member, since the magnetic field stiffens the developer, and hinders developer mixing in the development zone.

In many of the above described systems, undesirable degradation or deterioration of the developer particles results, which is generally caused by a number of factors, including, for example, the frequency of collisions between adjacent carrier particles contained in the developer compositions, which collisions adversely effect the developer conductivity, and also the triboelectric charging relationships between the toner particles and the magnetic carrier particles. This degradation, which most likely occurs in the development roller, at the metering and development zone, and in the developer supply reservoir in which fresh toner is added and triboelectrically charged by carrier particles, adversely effects the developer conductivity, and the triboelectric charging relationships between the toner particles and the magnetic carrier particles. Thus, a decrease in the triboelectric charge on the toner particles causes an increase in solid area development, and an increase in the amount of toner particles that are deposited in the background areas. Accordingly, in order to maintain the original image quality in such situations, the triboelectric charge on the toner particles is increased by reducing the concentration of such particles in the developer composition mixture. Further, when the toner charge and toner concentration decreases, the developer material must be replaced in order to obtain images with acceptable solid areas and decreased background areas.

There is also known as disclosed in related U.S. Pat. Nos. 4,394,429 and 4,368,970, a system for causing the development of images in electrostatographic imaging devices, which system utilizes a deflected flexible imaging member and insulating developer particles.

While several improved types of processes and systems have been developed for the purpose of developing images, difficulties continue to be encountered in the design of a simple, inexpensive and reliable two-component conductive development system which provides a highly solid area development rate, low background deposition, and long-term stability. Accordingly, there continues to be a need for processes which will improve the quality of the images produced, particularly in electrostatographic imaging systems, such as xerographic imaging systems, which are simple and economical to operate, and which result in reproducible high quality images, including both line and solid area image development. Additionally, there continues to be a need for the provision of a process employing contacting conductive carrier particles in order that charges can be rapidly transferred to the flexible imaging member; and wherein background development is substantially eliminated, and the useable life of the developer composition is increased.

SUMMARY OF THE INVENTION

It is therefore a feature of the present invention to provide an improved development process utilizing a two-component conductive developer composition which overcomes the above-noted disadvantages.

It is a further feature of the present invention to provide a self-agitated conductive development process which allows the production of images of high quality.

In yet another feature of the present invention there is provided a conductive development process wherein a conductive two-component developer is contained in a development zone situated between a moving deflected flexible imaging member, and a moving transporting member.

In another feature of the present invention there is provided a development process utilizing a two-component conductive developer composition, which process extends the useful life of the conductive developer composition.

A further important feature of the present invention resides in the provision of a process wherein the conductive carrier particles contained in the development zone are in contact, thereby allowing charge to rapidly flow toward the flexible imaging member.

These and other features of the present invention are accomplished by providing a self-agitated two-component conductive development process wherein toner particles are continuously available near the imaging surface, and there results an increased deposition of toner particles on a flexible imaging member. This is accomplished by bringing a transporting member, such as a development roller, and a tensioned deflected flexible imaging member, into close proximity, that is a distance of from about 0.05 millimeters to about 1.5 millimeters, and preferably from about 0.4 millimeters to about 1.0 millimeters, and causing such members to move at relative speeds in the presence of a high electric field. Agitation of the conductive developer particles contained in the development zone, and movement of the developer particles depends primarily on the arc or degree of deflection of the flexible imaging member, the relative speeds of, and the distance between the deflected flexible imaging member and the transporting member, a low magnetic field, and the magnitude of the electric field in the development zone, which electric field is inversely proportional to the developer thickness, and directly proportional to the difference in potential between the charged deflected imaging member, and the bias on the transporting member. Thus, for example, at a typical imaging potential of about 545 volts, a background potential of about 145 volts, and a transporting member bias of about 195 volts to suppress background deposition, the solid area development potential is about 350 volts across the conductive developer layer. For a preferred developer thickness of 0.5 millimeters, the development electric field is 300 volts across 0.5 millimeters.

The degree of developer agitation is proportional to the shear rate and development time, thus at a particular process speed, and at a particular transporting member speed, increased developer agitation is obtained when the developer layer is thin, and the development zone is long. The development zone length ranges from about 0.5 centimeters to about 5 centimeters with a preferred length being between about 1 centimeter and about 2 centimeters, however, lengths outside these ranges can be used providing the objectives of the present invention are accomplished.

More specifically, the present invention is directed to a process for causing the development of electrostatic latent images on an imaging member comprising providing a development zone situated between a tensioned deflected flexible imaging member, and a transporting member, adding conductive developer particles to the development zone, comprised of toner particles and conductive magnetic carrier particles, causing the flexible imaging member to move at speed of from about 5 cm/sec to about 80 cm/sec, causing the transporting member to move at a speed of from about 6 cm/sec to about 160 cm/sec, said flexible imaging member and said transporting member moving at different speeds, maintaining a distance between the tensioned deflected flexible imaging member and the transporting member of from about 0.05 millimeters to about 1.5 millimeters, introducing a high electric field in the development zone, wherein the developer particles contained in the development zone are agitated, thereby providing contact between the conductive carrier particles, causing charge to rapidly flow in the direction of the deflected imaging member, said process being accomplished in the presence of a low magnetic field of less than 150 gauss.

In a further embodiment, the present invention is directed to an electrostatographic imaging process, as illustrated in FIG. 2, comprising forming an electrostatic latent image on a tensioned flexible imaging member, followed by developing the image by a process which comprises providing a development zone situated between a tensioned deflected flexible imaging member, and a transporting member, adding conductive developer particles to the development zone, comprised of toner particles and conductive magnetic carrier particles, causing the flexible imaging member to move at a speed of from about 5 cm/sec to about 80 cm/sec, causing the transporting member to move at a speed of from about 6 cm/sec to about 160 cm/sec, said flexible member and said transporting member moving at different speeds, maintaining a distance between the tensioned deflected flexible imaging member and the transporting member, of from about 0.05 millimeters to about 1.5 millimeters, the flexible imaging member being deflected primarily by the conductive developer particles contained in the development zone, introducing a high electric field in the development zone, wherein the conductive developer particles contained in said zone are agitated, thereby providing contact between the conductive carrier particles, causing charge to rapidly flow in the direction of the deflected imaging member, said process being accomplished in the presence of a low magnetic field, less than 150 gauss, subsequently transferring the developed image to a substrate and permanently affixing the image thereto.

One important feature of the process of the present invention, which together with the relative movement of the flexible imaging member and the transporting member, is primarily responsible for the agitation of the conductive developer particles contained in the development zone, resides in the deflected flexible imaging member, this member being deflected in an arc of from about 5 degrees to about 50 degrees with respect to the transporting member. This deflection is caused primarily by the pressure exerted on the tensioned flexible imaging member by the conductive developer particles contained in the development zone. As a result of the presence of these particles, there is exerted on the tensioned flexible member a pressure of from about 0.01 pounds per square inch, to about 2 pounds per square inch, and preferably from about 0.1 pounds per square inch to about 1 pound per square inch. By being deflected, the imaging member exerts additional forces and specifically, a shear force on the conductive developer particles causing such particles to be agitated, which agitation would not occur with a rigid imaging member, as the geometry of a rigid configuration prevents containment of the developer particles, and will not allow the carrier particles to rotate or have a rocking motion. The pressure exerted on the flexible imaging member is also dependent on the tension and arc radius of the imaging member, thus the pressure P is obtained by dividing the tension T expressed in force per unit width of the deflected imaging member by the arc radius R of the imaging member, as represented by $$P = \frac{T}{R}.$$

Rotation or the rocking motion of the conductive carrier particles is essential to the process of the present invention since such motion allows charge to flow from, for example, the transporting member to the deflected flexible imaging member as illustrated in detail with reference to FIG. 1. Although it is not desired to be limited by theory, most likely the rocking motion removes toner particles situated between the conductive carrier particles to be removed causing the carrier particles to be in contact, and allowing charge to more easily flow toward the imaging member. In view of this, for example, the field existing in the immediate area of the flexible imaging member is strengthened causing an increased deposition of toner particles on the imaging member. Without the rapid flow of charge, such deposition would not occur on a continuous basis.

The flexible imaging member in contrast to a rigid imaging member, provides a normal or downward force on the conductive developer particles, in perpendicular relationship thereto, and such member also exerts a frictional force in parallel relationship to the deflected flexible imaging member and the transporting member, which frictional force causes agitation of the developer particles. Primarily as a result of agitation, the carrier particles rotate or are subjected to a rocking motion as illustrated with reference to FIG. 1, allowing charge to rapidly migrate toward the flexible imaging member. Agitation, and thus rotation of the conductive carrier particles, would not be accomplished with a rigid imaging member, since such a member exerts substantially no frictional force, and provides a substantially zero normal force.

The frictional force exerted by the flexible imaging member is dependent on a number of factors, including the degree of deflection of the imaging member, the tension in the imaging member, the coefficient of friction between the imaging member and the conductive developer particles, and the normal force. Thus, the frictional force exerted is a product of the coefficient of friction between the tensioned flexible imaging member and the conductive developer particles; and the normal force. The normal force exerted on one conductive developer particle is the product of the normal pressure and the projected area of the carrier particles.

By flexible imaging member as used herein is meant a member that is deformed or deflected such as the photoconductive compositions as described in U.S. Pat. No. 4,265,990. In contrast, a rigid imaging member cannot be easily deflected, such a member being stiff or hard, like amorphous selenium, which has not been deposited on a flexible substrate.

Improved developer agitation in the development zone, and better solid area development is also obtained when a low magnetic field or substantially no magnetic field is present in the development zone. Generally, the magnetic field is less than about 150 gauss, and preferably less than 75 gauss.

BRIEF DESCRIPTION OF THE DRAWINGS

For a better understanding of the present invention, and further features thereof, reference is made to the following detailed description of various preferred embodiments wherein.

DESCRIPTION OF PREFERRED EMBODIMENTS

Figure 1:
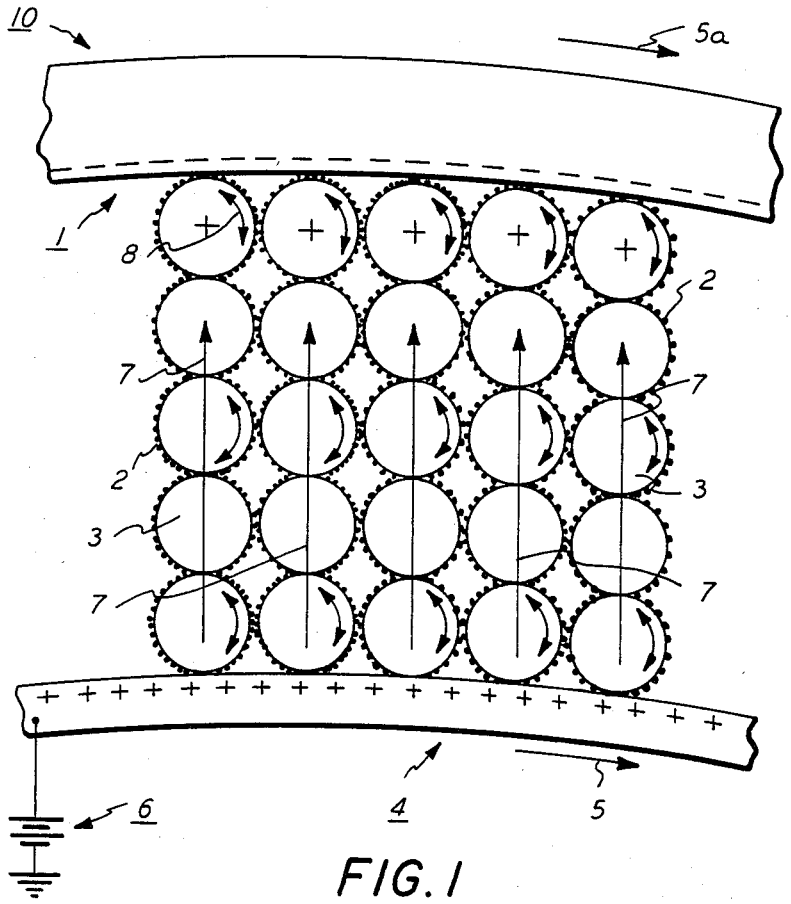
FIG. 1 is a partially schematic cross-sectional view of the development process of the present invention.

Illustrated in FIG. 1 is one embodiment of the development system and process of the present invention designated 10, a negatively charged deflected flexible image member 1, positively charged toner particles 2, attached to negatively charged contacting conductive carrier particles 3, a developer transporting member 4, which can also function as a development electrode, a biased voltage source 6, arrows 7 indicating the movement or flow of charge toward member 1, and arrows 8 illustrating that the carrier particles are rotating or are being subjected to a rocking motion. The deflected flexible imaging member 1, and developer transporting member 4, in this embodiment are moving in the direction shown by the arrows 5 and 5*a*. Also, in this illustration the transporting member 4 is moving at a more rapid rate of speed than the flexible imaging member 1, which difference in speed contributes to agitation and a shearing action in the development zone, thereby causing agitation and thus movement of the conductive carrier particles and the toner particles. This movement, especially the rocking motion of the conductive carrier particles, allows contact of the carrier particles, with substantially no toner particles being situated between each of the carrier particles as illustrated, this contact causing electrical charges to be transported to the carrier particles nearest the flexible imaging member as illustrated. Accordingly, the toner particles and carrier particles nearest the flexible imaging member are both positively charged providing for the release of more toner particles to the imaging surface, and thus allowing for superior development particularly solid area development. Furthermore, there occurs as a result of the transport of charge an increase in the electrical field on the toner particles nearest the flexible photoreceptor member, which increase allows the toner particles to overcome the adhesion forces between the toner particles and conductive carrier particles, causing an increase in the deposition of toner particles on the flexible imaging member. The distance between the flexible imaging member and the transport member or the thickness of the developer layer comprised of conductive carrier particles and insulating toner particles causes an increase in the electrical field and provides assistance in causing charge to be transported toward the flexible imaging member.

In the process of the present invention there is an increase in the amount of toner particles that are available nearest the flexible imaging member primarily because of the agitation of the carrier particles caused by the movement of the flexible imaging member and the transporting member. It is believed that such movement allows more of the conductive carrier surface to contact the flexible imaging member, in contrast to when no movement or agitation occurs since in such a situation, the carrier particles will remain motionless or in a stiff like chain thus preventing toner particles that are attached to portions of the conductive carrier particles not to be available for deposition on the flexible imaging member. It is not intended to be limited to this method of operation, nor to be limited to any theory of operation; thus other methods of operation are envisioned by this invention. For example the speed of the imaging member 1 can be greater than the speed of the transporting member 4, and movement can be in the opposite direction to that which is shown. Also the shape of the carrier particles is not necessarily completely spherical as shown, that is, most carrier particles are non-spherical with surfaces that can be jagged or textured. In certain embodiments the toner particles 2, can be charged negatively, and the carrier particles 3, can be charged positively. Such a developer would be useful in systems where the deflected flexible image bearing member is charged positively.

The arrows 8, within the conductive carrier particles 3, indicate that such particles are moving in both directions, first in one direction, for example, slightly to the right than in another direction, slightly to the left, referred to herein as a rocking motion. This movement or agitation, which results in improved development of images and allows the flow of charge toward the imaging member, reference arrows 7, is caused primarily by the force exerted by the tensioned deflected flexible imaging member, which force would not be exerted by a rigid imaging member and the relative movement of imaging member 1, and transporting member 4, as well as the other process conditions mentioned.

In one method of operation, as indicated hereinbefore, the transporting member 4 is moving at a surface speed which is faster than the speed of the flexible imaging member 1, both the transporting member and the deflected flexible imaging member moving in the same direction. This relative motion between member 4, and the deflected flexible imaging member 1, is a contributing factor in causing the developer composition, which is comprised of toner particles 2, and conductive carrier particles 3, to be agitated by a shearing action. When the speed of the flexible image bearing member 1, is less than the speed of the member 4, as shown in FIG. 1, the shearing action causes movement of the carrier particles 3, that is, the carrier particles move in both a clockwise and counterclockwise direction.

Movement of the conductive carrier particles allows contact between the carrier particles as illustrated, and this contact is essential for charge flow in the direction of the flexible imaging member 1. As a result of this movement, the number of toner particles available for presentation and deposition on the flexible imaging member are increased primarily because more surface area of the carrier particles exist as a result of rotation of such carrier particles. As indicated hereinbefore, in prior art systems, wherein no rotation of the carrier particles exists only those toner particles attached to the top portion of the carrier particles are available for deposition, or less toner particles, than would be available when the carrier particles are caused to rotate in accordance with the development process of the present invention.

The degree of developer agitation can be defined by the product of the shear rate and development time. The average shear rate is equal to the absolute value of the difference in the development roller or electrode velocity, $V_R$, and imaging member velocity, $V_I$, divided by the developer thickness, L, i.e., the average shear rate equals $|V_R - V_I|/L$. The development time is equal to the development zone length, W, divided by the absolute value of the developer roller speed, $|V_R|$; i.e, the development time equals $W/|V_R|$. Thus the degree of developer agitation is equal to $(|V_R - V_I|/L) \times (W/|V_R|)$ or $[|1 - 1/V|]$ where V is equal to $V_R/V_I$ and is positive or negative when the development roller or electrode moves in the same or opposite direction to the image bearing member respectively. It is assumed that the quantity $1-1/V$, is typically near a value of 1 in which case the degree of developer agitation is approximated by W/L, i.e., the ratio of the developer zone length to the developer layer thickness. When the development zone length ranges from 0.5 cm to 5 cm (W) with a preferred length of 1 cm to 2 cm and the developer layer ranges in thickness of from about 0.05 mm to 1.5 mm (L) and preferably about 0.4 mm to 1.0 mm, the developer agitation ranges from 2 to 1,000 and preferably from 10 to 50.

When the process of the present invention is utilized in an electrostatographic imaging system, there is provided increased solid area development with low toner concentration. The minimum toner concentration for acceptable solid area development depends on several factors including, for example, the ratio of the speed of movement between the transporting member and flexible imaging member and the degree of developer agitation. Thus, for example, for a developer containing 2.5 percent by weight of toner particles mixed with about 97.5 percent by weight of 150 um diameter conductive iron grit carrier particles, solid area development is 0.5 $mg/cm^2$ for a development voltage of 300 volts, a speed ratio of 2, a magnetic field of less than 50 gauss, a development zone length of 2.0 cm and a developer layer thickness of 0.5 mm.

Figure 2:
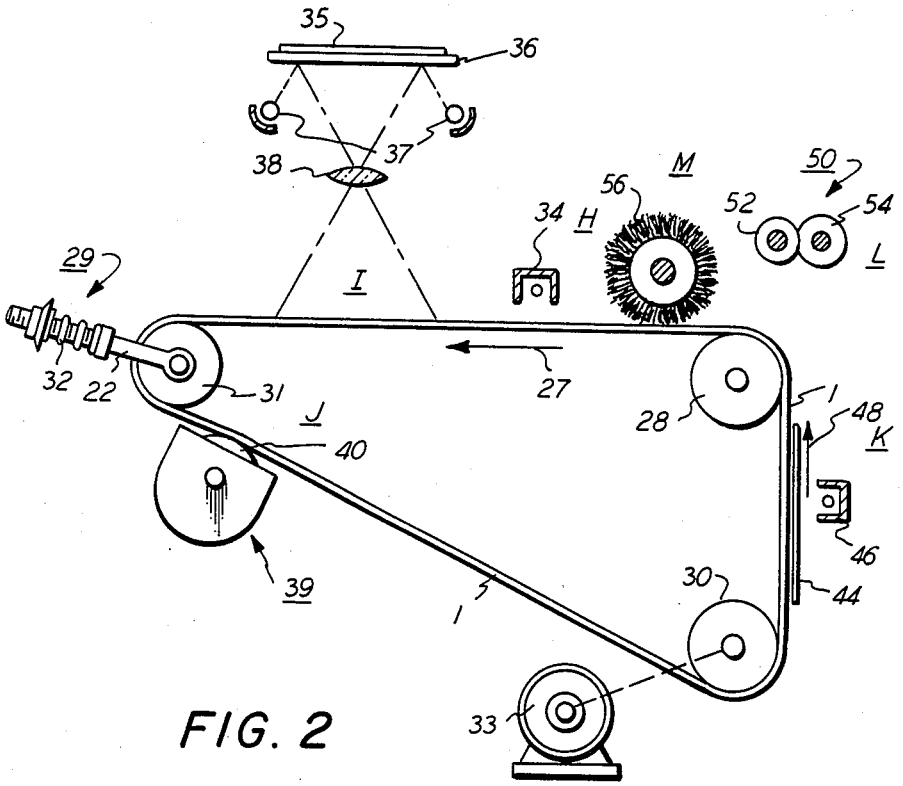
FIG. 2 illustrates an electrostatographic imaging system utilizing the process of the present invention.

The process of the present invention can be useful in various imaging systems including electronic printing devices and electrostatographic imaging environments such as those employing xerographic apparatus well-known in the art. In FIG. 2, there is illustrated an electrostatographic printing machine employing a deflected flexible imaging member 1 having a photoconductive surface deposited on a conductive substrate, such as aluminized Mylar, which is electrically grounded. The imaging member 1 can be comprised of numerous suitable materials as described herein for example, however, for this illustration the photoconductive material is comprised of a transport layer containing small molecules of N,N,N',N'-tetraphenyl-1,1'-biphenyl 4,4'-diamine, or similar diamines (m-TBD) dispersed in a polycarbonate and a photogeneration layer of trigonal selenium. Deflected flexible imaging member 1 moves in the directon of arrow 27 to advance successive portions of the photoconductive surface sequentially through the various processing stations disposed about the path of movement thereof. The imaging member is entrained about a sheet-stripping roller 28, tensioning means 29, and drive roller 30. Tensioning system 29 includes a roller 31 having flanges on opposite sides thereof to define a path through which member 1 moves. Roller 31 is mounted on each end of guides attached to the springs. Spring 32 is tensioned such that roller 31 presses against the imaging belt member 1. In this way, member 1 is placed under the desired tension. The level of tension is relatively low permitting member 1 to be relatively easily deformed. With continued reference to FIG. 2, drive roller 30 is mounted rotatably and in engagement with member 1. Motor 33 rotates roller 30 to advance member 1 in the direction of arrow 27. Roller 30 is coupled to motor 33 by suitable means such as a belt drive. Sheet-stripping roller 28 is freely rotatable so as to readily permit member 1 to move in the direction of arrow 27 with a minimum of friction.

Initially, a portion of imaging member 1 passes through charging station H. At charging station H, a corona generating device, indicated generally by the reference numeral 34, charges the photoconductive surface of imaging member 1 to a relatively high, substantially uniform potential.

The charged portion of the photoconductive surface is then advanced through exposure station I. An original document 35 is positioned face down upon transparent platen 36. Lamps 37 flash light rays onto original document 35. The light rays reflected from original document 35 are transmitted through lens 38 forming a light image thereof. Lens 38 focuses the light image onto the charged portion of the photoconductive surface to selectively dissipate the charge thereon. This records an electrostatic latent image on the photoconductive surface which coresponds to the informational areas contained within original document 35.

Thereafter, imaging member 1 advances the electrostatic latent image recorded on the photoconductive surface to development station J. At development station J, a self-agitated development system, indicated generally by the reference numeral 39, advances a developer material into contact with the electrostatic latent imge. The self-agitated development system 39 includes a developer roller 40 which transports a layer of conductive developer material comprising magnetic conductive carrier particles and toner particles into contact with the deflected flexible imaging member 1. As shown, developer roller 40 is positioned such that the brush of developer material deforms imaging member 1 in an arc such that member 1 conforms at least partially, to the configuration of the developer material. The electrostatic latent image attracts the toner particles from the conductive carrier particles forming a toner powder image on the photoconductive surface of member 1. The development roller 40 returns the developer material to the sump of development system 39 for subsequent re-use. The process of development has been described herein, reference FIG. 1.

Imaging member 1 then advances the toner powder image to transfer station K. At transfer station K, a sheet of support material 44 is moved into contact with the toner powder image. The sheet of support material 44 is advanced to transfer station K by a sheet feeding apparatus (not shown). Preferably, the sheet feeding apparatus includes a feed roll contacting the uppermost sheet of a stack of sheets. The feed roll rotates so as to advance the uppermost sheet from the stack into a chute. The chute directs the advancing sheet of support material into contact with the photoconductive surface of member 1 in a timed sequence so that the toner powder image developed thereon contacts the advancing sheet of support material at transfer station K.

Transfer station K includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station L.

Fusing station L includes a fuser assembly, indicated generally by the reference numeral 50, which permanently affixes the transferred toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

After the sheet of support material is separated from the photoconductive surface or imaging member 1 some residual particles remain adhering thereto, which particles are removed from the photoconductive surface to cleaning station M. Cleaning station M includes a rotatably mounted fibrous brush 56 in contact with the photoconductive surface. The particles are cleaned from the photoconductive surface by the rotation of brush 56 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the process of the present invention therein.

Illustrative examples of the deflected flexible image bearing member 1, include inorganic and organic photoreceptor materials including, for example, inorganic materials deposited on a flexible substrate. Examples of these materials include amorphous selenium, selenium alloys, including alloys of selenium-tellurium, selenium arsenic, selenium antimony, and selenium-tellurium-arsenic; cadmium sulfide, zinc oxide, and the like; while examples of flexible organic materials include layered organic photoreceptors, such as those containing as an injecting contact, carbon dispersed in a polymer, which is overcoated with a transport layer, which in turn is overcoated with a generating layer, and finally an overcoating of an insulating organic resin, described in U.S. Pat. No. 4,251,612, the disclosure of which is totally incorporated herein by reference; and layered photoreceptor devices comprised of a substrate, a transport layer and a generating layer described in U.S. Pat. No. 4,265,990, the disclosure of which is totally incorporated herein by reference.

Examples of other flexible imaging member materials include organic photoreceptor materials such as 4-dimethylamino-benzylidene, benzhydrazide; 2-benzylidene-amino-carbazole, 2-benzylidene-amino-carbazole, polyvinyl carbazole; (2-nitro-benzylidene)-p-bromo-aniline; 2,4-diphenyl quinazoline; 1,2,4-triazine; 1,5-diphenyl-3-methyl pyrazoline 2-(4'-dimethyl-amino phenyl)benzoxazole; 3-amino-carbazole; polyvinylcarbazole-trinitrofluorenone charge transfer complex; phthalocyanines, mixtures thereof, and the like.

Illustrative examples of the transporting member 4 include virtually any conducting material made for this purpose, such as stainless steel, aluminum and the like. Texture in member 4 provides traction necessary for good developer transport from the developer sump and through the development zone. The development roll texture is obtained by one of several methods involving flame-spray treating, etching, knurling, and the like.

The developer material is comprised of an electrically insulating pigment particles, and conducting magnetic carrier particles. By conducting is meant, for example, that charge tends to flow from the transport member to the ends of the carrier particles nearest the image bearing member within a time that is less than the development time. With such materials, the range of development times is calculated as follows:

Longest Time $$W = \frac{5\text{ cm (length of development zone)}}{6\text{ cm/sec (speed of transport member)}} = 0.83\text{ seconds}$$

Shortest Time $$W' = \frac{0.5\text{ cm}}{160\text{ cm/sec}} = .0031\text{ seconds}$$

While any suitable material may be employed as the toner resin in the system of the present invention, typical of such resins are polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl naphthalene, ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, arylamide, vinyl ethers such as vinyl methyl ether, vinyl isobutyl ether, vinyl ethyl ether, and the like; vinyl ketones such as vinyl methyl ketone, vinyl hexyl ketone, methyl isopropenylketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also esterification products of a dicarboxylic acid and a diol comprising a diphenol may be used as a preferred resin material for the toner composition of the present invention. These materials are ilustrated in U.S. Pat. No. 3,655,374, totally incorporated herein by reference, the diphenol reactant being of the formula as shown in column 4, line 5 of this patent and the dicarboxylic acid being of the formula as shown in column 6 of the above patent. The resin is present in an amount so that the total of all ingredients used in the toner total about 100 percent, thus when 5 percent by weight of the alkyl pyridinium compound is used and 10 percent by weight of pigment such as carbon black, about 85 percent by weight of resin material is used.

Optimum electrophotographic resins are achieved with styrene butylmethacrylate copolymers, styrene vinyl toluene copolymers, styrene acrylate copolymers, polyester resins, predominantly styrene or polystyrene based resins as generally described in U.S. Pat. No. 24,136 and polystyrene blends as described in U.S. Pat. No. 2,788,288.

The toner resin particles can vary in diameter, but generally range from about 5 microns to about 30 microns in diameter, and preferably from about 10 microns to about 20 microns.

Various suitable pigments or dyes may be employed as the colorant for the toner particles, such materials being well known and including for example, carbon black, nigrosine dye, aniline blue, chrome yellow, DuPont oil red, phthalocyanine blue and mixtures thereof. The pigment or dye should be present in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Inc. Preferably the pigment is employed in amounts of from about 3 percent to about 20 percent by weight based on the total weight of toner, however, if the toner color employed is a dye, substantially smaller quantities of the colorant may be used.

Additionally, there can be incorporated into the toner particles various charge enhancing agents, primarily for the purpose of imparting a positive or negative charge to the toner resin. Examples of charge enhancing agents imparting a positive charge to the toner resin include quaternary ammonium compounds, as described in U.S. Pat. No. 3,970,571, and alkyl pyridinium halides, such as cetyl pyridinium chloride as described in U.S. Pat. No. 4,298,672, the disclosure of this patent being totally incorporated herein by reference.

Numerous various suitable magnetic conductive carrier particles can be employed provided that such materials are conductive in accordance with the process of the present invention. Examples of various conductive carrier particles include those well known in the art, such as steel, nickel, iron, magnetites, and the like. Carrier coatings can be applied to the carrier particles providing that the carrier particles retain their conductivity. Illustrative examples of such coatings include fluoropolymers such as polyvinylidene fluoride and the like. Additionally, other types of conductive carrier particles are useful in the process of the present invention, including conductive nickel berry carriers as described, for example, in U.S. Pat. No. 3,847,604.

Generally, the diameter of the carrier particles ranges from about 25 to about 1,000 microns, thus allowing such particles to possess sufficient density and inertia to avoid adherance to the electrostatic latent images during the development process.

The developer composition is prepared by melt blending followed by mechanical attrition of from about 1 part to 3 parts of toner particles to about 100 parts of carrier particles.

Other modifications of the present invention may occur to those skilled in the art based upon a reading of the present disclosure, these are intended to be included within the scope of the present invention.

I claim:

1. An improved process for causing the development of electrostatic latent images on an imaging member, comprising providing a development zone ranging in length of from about 0.5 centimeters to about 5 centimeters, which development zone is encompassed by a tensioned deflected flexible imaging member and a transporting member, wherein the flexible imaging member is comprised of a supporting substrate, a photogenerating layer, and a transport layer comprised of electrically active diamine molecules dispersed in an inactive resinous binder, the diamine molecules being of the formula

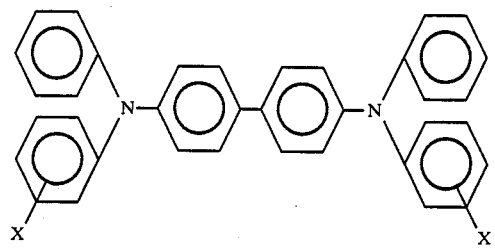

wherein X is selected from the group consisting of (ortho) $CH_3$, (meta) $CH_3$, (para) $CH_3$, (ortho) Cl, (meta) Cl, (para) Cl, causing the deflected flexible imaging member to move at a speed of from about 5 cm/sec to about 80 cm/sec, causing the transporting member to move a speed of from about 6 cm/sec to about 160 cm/sec, said deflected flexible imaging member and said transporting member moving at different rates of speed, maintaining a distance between the flexible imaging member and the transporting member of from about 0.05 millimeters to about 1.5 millimeters, adding conductive developer particles to the development zone, which particles are comprised of toner particles and conductive magnetic carrier particles, introducing a high electrical field in the development zone, wherein the developer particles contained in the development zone are agitated, thereby providing contact between the conductive carrier particles, causing charge to rapidly flow in the direction of deflected flexible imaging member, said process being accomplished in the presence of a low magnetic field of less than 150 gauss, and wherein the development time is from about 0.83 seconds to about 0.0031 seconds.

2. An improved process in accordance with claim 1 wherein the flexible imaging member is deflected in the form of an arc of from about 5 degress to about 50 degrees.

3. An improved process in accordance with claim 1 wherein the distance between the deflected flexible imaging member and the transporting member ranges from about 0.04 millimeters to about 1.0 millimeters.

4. An improved process in accordance with claim 1 wherein the deflected flexible imaging member and transporting member are moving in the same direction, or in opposite directions.

5. An improved process in accordance with claim 1 wherein the toner particles contained in the developer composition are charged positively, the conductive magnetic carrier particles are charged negatively, and the flexbile imaging member is charged negatively.

6. An improved process in accordance with claim 1 wherein the toner particles contained in the developer composition are charged negatively, the conductive magnetic carrier particles are charged positively and the deflected flexible imaging member is charged positively.

7. An improved process in accordance with claim 1 wherein the flexible imaging member is deflected in the form of an arc of from about 5 degrees to about 50 degrees.

8. An improved process in accordance with claim 1 wherein charge is caused to flow in the direction of the imaging member thereby increasing the number of toner particles available for deposition on the flexible imaging member.

9. An improved electrostatographic imaging process which comprises forming an electrostatic latent image on a deflected flexible imaging member followed by developing the image by a process which comprises providing a development zone ranging in length of from about 0.5 centimeters to about 5 centimeters, which development zone is encompassed by a tensioned deflected flexible imaging member and a transporting member, wherein the flexible imaging member is comprised of a supporting substrate, a photogenerating layer, and a transport layer comprised of electrically active diamine molecules dispersed in an inactive resinous binder, the diamine molecules being of the formula

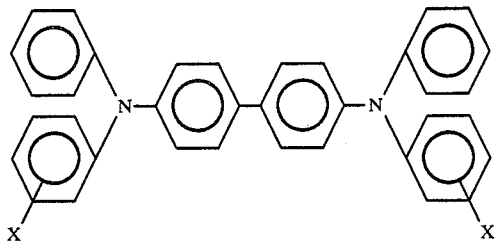

wherein X is selected from the group consisting of (ortho) $CH_3$, (meta) $CH_3$, (para) $CH_3$, (ortho) Cl, (meta) Cl, (para) Cl, causing the deflected flexible imaging member to move at a speed of from about 5 cm/sec to about 80 cm/sec, causing the transporting member to move at a speed of from about 6 cm/sec to about 160 cm/sec, said deflected flexible imaging member and said transporting member moving at different rates of speed, maintaining a distance between the flexible imaging member and the transporting member of from about 0.05 millimeters to about 1.5 millimeters, adding conductive developer particles to the development zone, which particles are comprised of toner particles and conductive magnetic carrier particles, introducing a high electrical field in the development zone, wherein the developer particles contained in the development zone are agitated, thereby providing contact between the conductive carrier particles, causing charge to rapidly flow in the direction of deflected flexible imaging member, said process being accomplished in the presence of a low magnetic field of less than 150 gauss, and wherein the development time is from about 0.83 seconds to about 0.0031 seconds.

10. An improved process in accordance with claim 9 wherein the distance between the deflected flexible imaging member and the transporting member ranges from about 0.04 millimeters to about 1.0 millimeters.

11. An improved process in accordance with claim 9 wherein the deflected flexible imaging member and transporting member are moving in the same direction, or in opposite directions.

12. An improved process in accordance with claim 9 wherein the toner particles contained in the developer composition are charged positively, the conductive magnetic carrier particles are charged negatively, and the flexible imaging member is charged negatively.

13. An improved process in accordance with claim 9 wherein the toner particles contained in the developer composition are charged negatively, the conductive magnetic carrier particles are charged positively, and the flexible imaging member is charged positively.

* * * * *